US007143475B2

(12) United States Patent
Annes et al.

(10) Patent No.: US 7,143,475 B2
(45) **Date of Patent: *Dec. 5, 2006**

(54) BLOCK AND TACKLE BALANCE ASSEMBLY WITH BRAKE SHOE

(75) Inventors: Jason Annes, Chicago, IL (US); Ralph Soles, Brandon, SD (US)

(73) Assignee: Newell Operating Company, Atlanta, GA (US)

( * ) Notice: Subject to any disclaimer, the term of this patent is extended or adjusted under 35 U.S.C. 154(b) by 169 days.

This patent is subject to a terminal disclaimer.

(21) Appl. No.: 10/457,582

(22) Filed: Jun. 9, 2003

(65) Prior Publication Data

US 2003/0213096 A1 Nov. 20, 2003

Related U.S. Application Data

(63) Continuation of application No. 09/875,636, filed on Jun. 6, 2001, now Pat. No. 6,622,342.

(51) Int. Cl.
*E05D 15/22* (2006.01)

(52) U.S. Cl. ..... 16/197; 49/445

(58) Field of Classification Search ..... 16/197, 16/193, DIG. 16; 49/445, 447
See application file for complete search history.

(56) References Cited

U.S. PATENT DOCUMENTS

| | | | |
|---|---|---|---|
| 1,007,212 | A | 10/1911 | Lasersohn |
| 1,312,665 | A | 8/1919 | Almquist |
| 2,178,533 | A | 10/1939 | Viehweger |
| 2,952,884 | A | 9/1960 | Dinsmore |
| 3,007,194 | A | 11/1961 | Griswold |
| 3,497,999 | A | 3/1970 | Hendra |
| 3,676,956 | A | 7/1972 | Taylor et al. |
| 3,732,594 | A | 5/1973 | Mills |
| 3,869,754 | A | 3/1975 | Foster |
| 4,068,406 | A | 1/1978 | Wood |
| 4,079,549 | A | 3/1978 | Wood |
| 4,089,085 | A | 5/1978 | Fitzgibbon |
| 4,190,930 | A | 3/1980 | Prosser |
| 4,300,316 | A | 11/1981 | Ficurilli |
| 4,332,054 | A | 6/1982 | Paist et al. |
| 4,506,478 | A | 3/1985 | Anderson |
| 4,510,713 | A | 4/1985 | Anderson |
| 4,610,108 | A | 9/1986 | Marshik |
| 4,697,304 | A | 10/1987 | Overgard |
| 4,930,254 | A | 6/1990 | Valentin |
| 4,941,285 | A | 7/1990 | Westfall |
| 4,949,425 | A | 8/1990 | Dodson et al. |
| 4,958,462 | A | 9/1990 | Cross |
| 5,069,001 | A | 12/1991 | Makarowski |
| 5,127,192 | A | 7/1992 | Cross |

(Continued)

OTHER PUBLICATIONS

"One Size Does Not Fit All—Opening Windows to the World," Balance Systems—BSI, Amesbury Group Inc., Fenestration Magazine, May 2000.

(Continued)

*Primary Examiner*—Gary S. Hartmann
(74) *Attorney, Agent, or Firm*—Banner & Witcoff, Ltd.

(57) ABSTRACT

A sash balance brake shoe assembly (2) is disclosed for counterbalancing a sash window (3) slidably supported within a master frame (5). The assembly generally includes a balance assembly preferably in the form of a block and tackle balance assembly (7) and a brake shoe (28). The balance assembly has a balance channel (6). The brake shoe (28) has an extension member (36) that is received by the balance channel (6). A fastener (42) directly connects the brake shoe (28) to the balance channel (6).

7 Claims, 7 Drawing Sheets

U.S. PATENT DOCUMENTS

| | | | | |
|---|---|---|---|---|
| 5,189,838 | A | 3/1993 | Westfall | |
| 5,210,976 | A * | 5/1993 | Cripps | 49/181 |
| 5,251,401 | A | 10/1993 | Prete et al. | |
| 5,301,467 | A | 4/1994 | Schmidt et al. | |
| 5,353,548 | A | 10/1994 | Westfall | |
| 5,377,384 | A | 1/1995 | Riegelman | |
| 5,445,364 | A | 8/1995 | Tibbals, Jr. | |
| 5,448,858 | A | 9/1995 | Briggs et al. | |
| 5,452,495 | A | 9/1995 | Briggs | |
| 5,463,793 | A | 11/1995 | Westfall | |
| 5,530,991 | A | 7/1996 | deNormand et al. | |
| 5,632,117 | A | 5/1997 | Prete et al. | |
| 5,669,180 | A | 9/1997 | Maier | |
| 5,697,188 | A | 12/1997 | Fullick et al. | |
| 5,737,877 | A | 4/1998 | Meunier et al. | |
| 5,829,196 | A | 11/1998 | Maier | |
| 5,855,092 | A | 1/1999 | Raap et al. | |
| 5,873,199 | A | 2/1999 | Meunier et al. | |
| 6,032,417 | A | 3/2000 | Jakus et al. | |
| 6,041,475 | A | 3/2000 | Nidelkoff | |
| 6,041,476 | A | 3/2000 | deNormand | |
| 6,119,398 | A | 9/2000 | Yates | |
| 6,467,128 | B1 | 10/2002 | Damani | |
| 6,470,530 | B1 | 10/2002 | Trunkle | |
| 6,679,000 | B1 * | 1/2004 | Uken et al. | 49/181 |
| 2002/0129463 | A1 | 9/2002 | Newman | |

OTHER PUBLICATIONS

"BSI's Hidden Advantage: It's as Easy as 1-2-3," Balance Systems—BSI, Amesbury Group Inc., Fenestration Magazine, May 2001, vol. 14, No. 6, p. 33.

* cited by examiner

BLOCK AND TACKLE BALANCE ASSEMBLY WITH BRAKE SHOE

RELATED APPLICATION

This application claims the benefit of, and is a continuation of, prior U.S. application No. 09/875,636, filed Jun. 6, 2001, issued as U.S. Pat. No. 6,622,342 on Sep. 23, 2003, which is expressly incorporated herein by reference and made a part hereof.

TECHNICAL FIELD

This invention relates generally to a window balance system and more particularly to a block and tackle balance and brake shoe assembly for a sliding sash window.

BACKGROUND OF THE INVENTION

A sash window arrangement disposed within a frame is well known. The frame is comprised of a pair of opposed vertical tracks or jams. The tracks are adapted to slidably guide a pair of sash windows within the frame.

Various types of balance systems are known and are used to counterbalance the weight of the sash window. In particular, block and tackle counter balance assemblies are known and have become popular due to their combination of relatively compact size and ease of installation. The block and tackle balance combines a system of pulleys and an extension spring mounted within a rigid balance channel for conversion of a high spring tension applied over a short working distance to a lower tension applied over a longer working distance. The extension spring is anchored at one end of the balance channel and the pulley system is anchored at the other end of the channel.

A traditional arrangement utilizing a block and tackle balance is disclosed in U.S. Pat. No. 5,530,991 to deNormand. In deNormand '991, an end of the balance channel is attached to the track via a hook or other intermediate structure. An end of a cord reeved through the pulley system and extending from a second end of the channel is attached, via a hook or other intermediate structure, to a shoe. This shoe is in turn attached to the window sash and slides therewith, within the track. An inverted block and tackle counterbalance system is disclosed by U.S. Pat. No. 6,041,476 to deNormand. In this arrangement, the end of the cord extending from the channel is attached to the track via a hook or other intermediate structure. The balance channel is then attached to the sash shoe via a hook or other intermediate structure such that the balance channel slides within the track as the window slides within the frame.

A disadvantage encountered with use of the block and tackle balance system is that it limits the range of slidable motion available to the window sash. This results in ultimately limiting the size of the opening available to an occupant of an enclosure during an event of emergency, such as a fire or other reason necessitating rapid egress. An additional disadvantage realized through use of the prior art block and tackle balance arrangements is that after extended use, the connecting mechanism between the balance channel and the sash shoe, or between the balance channel and the track, may deteriorate. This results in possible sudden detachment of the balance channel from the shoe or the track. If such detachment occurs, replacement of parts or other repairs resulting from the accompanying rapid movement of the block and balance channel and/or sash may be required.

The present invention is provided to solve these and other problems.

SUMMARY OF THE INVENTION

The present invention provides a block and tackle balance assembly which allows for a greater range of motion of the window sash. The present invention also provides a block and tackle assembly which allows for an improved connection between the brake shoe and the block and tackle balance assembly.

According to one aspect of the present invention, a sash balance and brake shoe assembly for counterbalancing and locking a slidable sash window within a track is provided. The assembly comprises a block and tackle balance assembly that includes a balance channel formed from a base and a pair of substantially parallel channel walls adapted for slidable mounting within the track. The assembly also includes a brake shoe adapted for slidable movement within the track wherein the brake shoe is attached directly to the balance channel.

According to another aspect of the present invention, a sash balance and brake shoe assembly for counterbalancing and locking a slidable sash window within a track is provided. The track has a pair of spaced apart, opposed side walls. The assembly comprises a block and tackle balance channel formed from a base and a pair of substantially parallel channel walls adapted for slidable mounting within the track. The assembly further comprises a brake shoe adapted for slidable movement within the track wherein the balance channel is adapted to receive the brake shoe and both the balance channel and brake shoe are adapted to directly fix the brake shoe to the balance channel.

Other features and advantages of the invention will be apparent from the following specification taken in conjunction with the following drawings.

BRIEF DESCRIPTION OF THE DRAWINGS

The pivoting and sliding device of the invention will now be described with reference to the accompanying drawings, in which.

DETAILED DESCRIPTION

Figure 1:
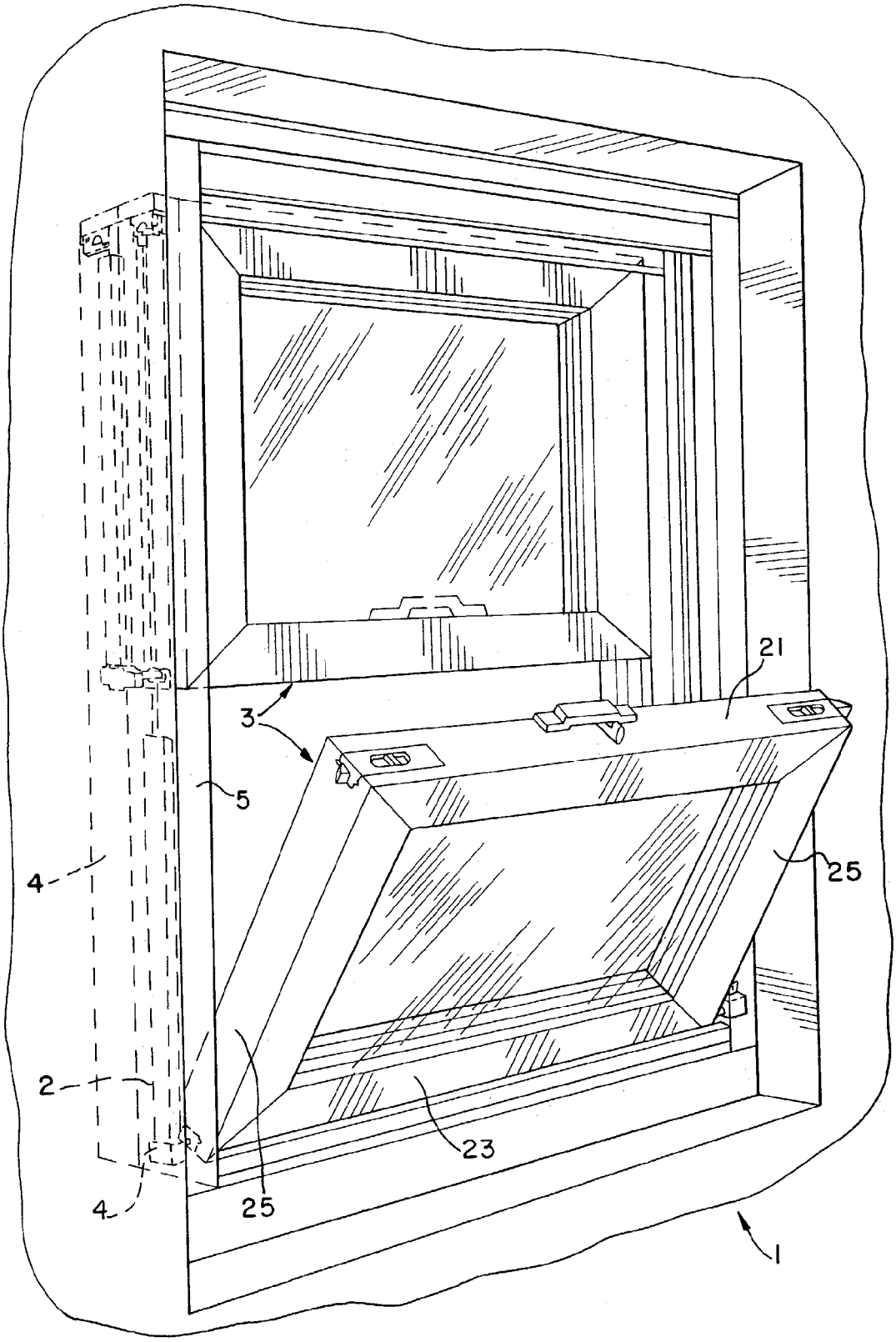
FIG. 1 shows a perspective view of a double hung window assembly with the present invention shown in phantom.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 21:
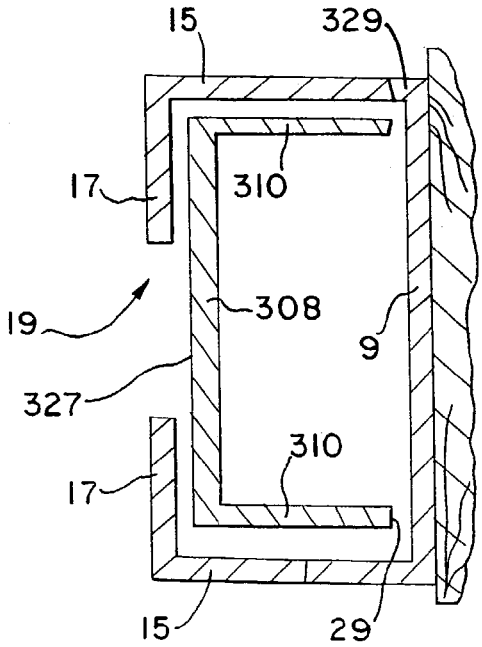
FIG. 21 is a cross sectional view of the third embodiment of the sash balance and brake shoe assembly of the present invention mounted within a track of a window frame.

FIG. 1 shows a double hung window assembly 1 having a pair of sash windows 3 slidably disposed in a master frame 5. Each sash window 3 is comprised of a top sash rail 21, a base sash rail 23 and a pair of vertical stiles 25. The master frame 5 has two pair of vertical tracks or shoe channels 4. Each vertical track or shoe channel 4, as shown in FIG. 21 is comprised of a rear wall 9, a pair of lateral walls 15 and a front wall consisting of a pair of shoulders 17. The shoulders 17 are separated by a slot 19 extending substantially the length of the track or shoe channel 4.

A sash balance brake shoe assembly 2 is mounted within the track 4 and provides a counter balance force to sash windows 3. The sash balance brake shoe assembly 2 generally includes a block and tackle balance assembly 7 and a brake shoe 28 (FIG. 2).

Figure 2:
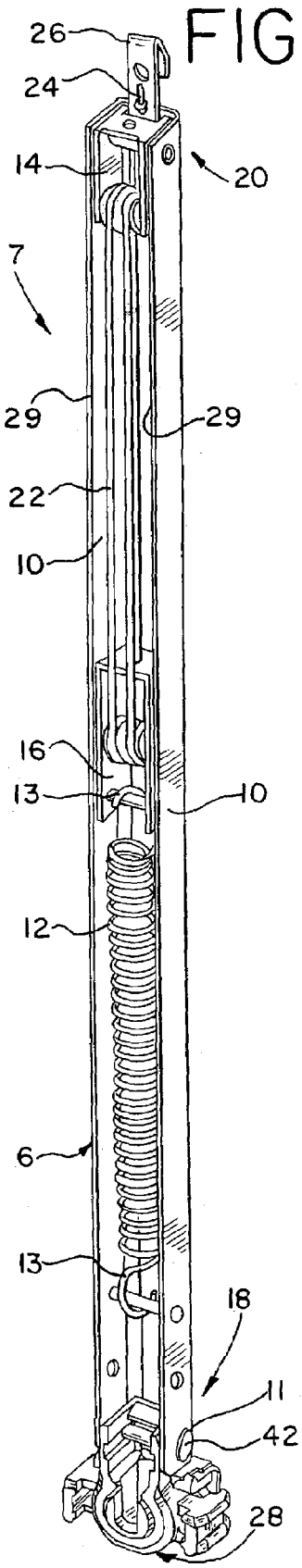
FIG. 2 shows a front perspective view of a sash balance brake shoe assembly of the present invention.

Referring to FIG. 2, the block and tackle balance assembly 7 generally includes a balance channel 6, an extension spring 12, a pulley system comprised of a first pulley block 14 and a second pulley block 16, and a cord 22. The balance channel 6 has a base 8, with an outer surface 27, and a pair of side walls 10. Each side wall has a peripheral edge 29 distal from the base 8. The balance channel 6 further has a first end 18 and a second end 20. At the first end 18, the balance channel 6 has a pair of openings 11, one each located in a respective side wall 10.

The extension spring 12 has a hook 13 formed in each end thereof. One end of extension spring 12 is rigidly fixed to the balance channel 6 in the proximity of the first end 18 via a rivet or other suitable connecting means. The first pulley block 14 is rigidly fixed to the second end 20 of balance channel 6 via a rivet or other suitable connecting means. A second end of the extension spring 12, via the hook 13 formed therein, is attached to the second pulley block 16. The cord 22 is fixed to the second pulley block 16, and reeved alternatingly through the first pulley block 14 and second pulley block 16. A free end 24 of the cord 22 extends out of the balance channel 6 through its second end 20. Attached to the free end 24 is a jam hook 26 adapted to be connected to track 4, such connection shown substantially in FIG. 1.

Figure 5:
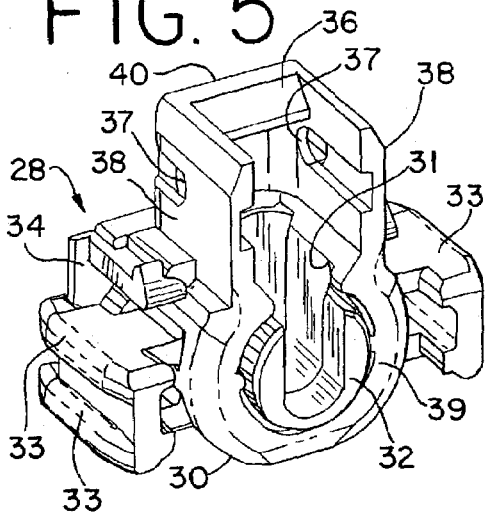
FIG. 5 shows a front perspective view of the brake shoe of the device of FIG. 2.
Figure 6:
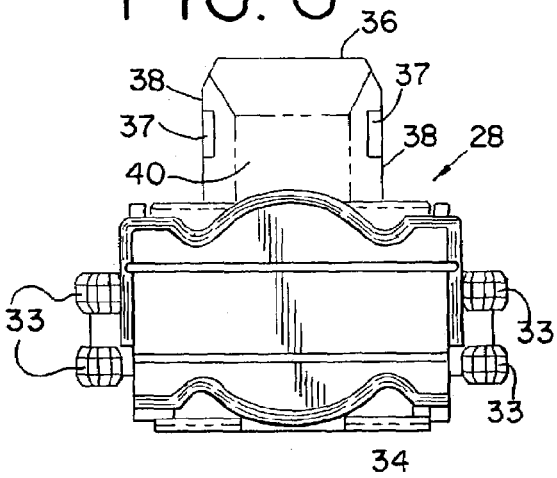
FIG. 6 shows a rear elevation view of the brake shoe of FIG. 2.
Figure 7:
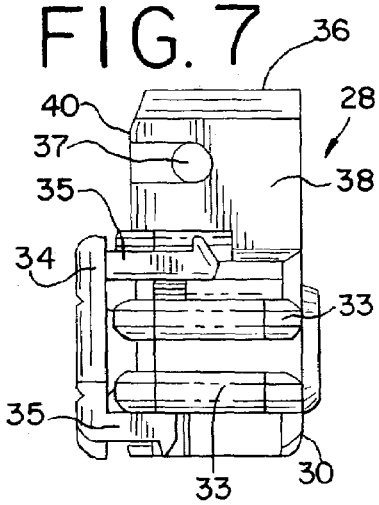
FIG. 7 shows a side elevation view of the brake shoe of FIG. 2.
Figure 8:
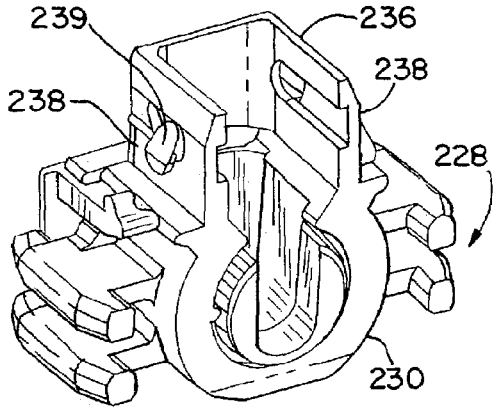
FIG. 8 shows a front perspective of a brake shoe of a second embodiment of the present invention.
Figure 9:
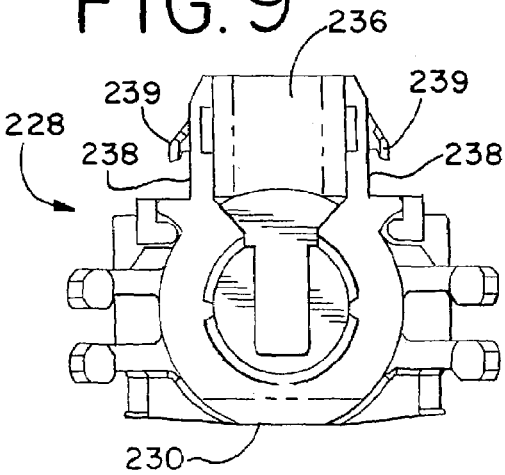
FIG. 9 shows a front elevation view of the brake shoe of a second embodiment of the present invention.
Figure 10:
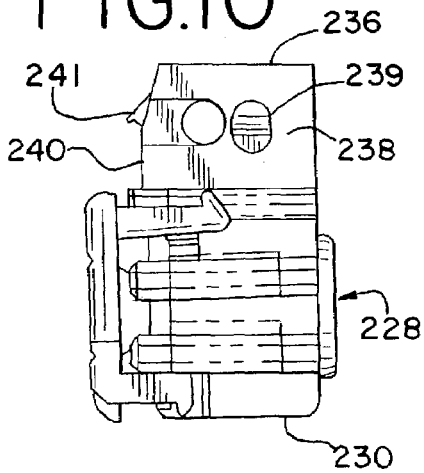
FIG. 10 shows a side elevation view of the brake shoe of a second embodiment of the present invention.
Figure 11:
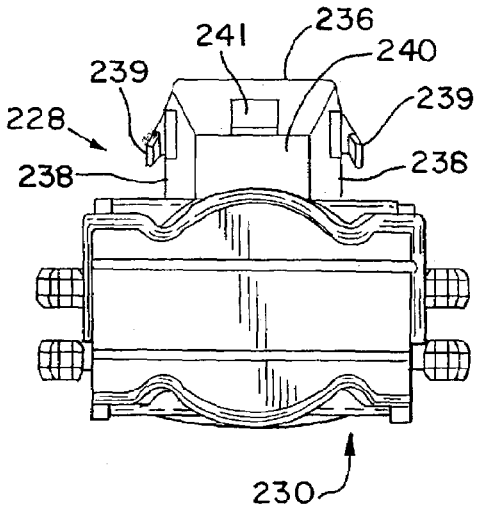
FIG. 11 shows a rear elevation view a brake shoe of a second embodiment of the present invention.
Figure 12:
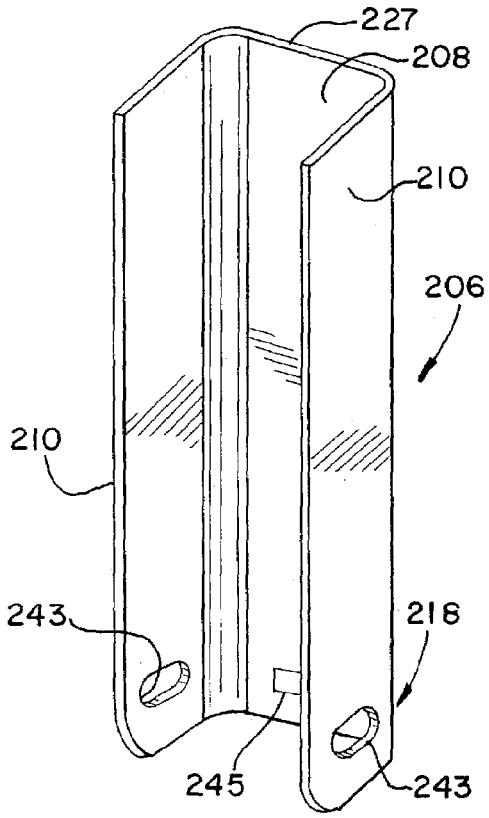
FIG. 12 shows a front perspective view of a balance channel of a second embodiment of the present invention.

As shown in FIGS. 5–7, the brake shoe 28 generally includes a slider body 30, cam 32 and a brake pad 34. Formed in the slider body 30 is a central opening 31, adapted to receive the cam 32. The central opening 31 extends from a front face 39 to the rear of slider body 30. Guides 33 are formed on slider body 30 to facilitate its sliding motion within the track 4. The brake pad 34 is adapted to be received by the slider body 30 via a plurality of fingers 35. The cam 32 receives a pivot bar attached to the window sash 3. When the window sash 3 is pivoted from the master frame 5, the pivot bar rotates the cam 32. Camming surfaces between the cam 32 and the brake pad 34 cam the brake pad 34 into frictional engagement with the rear wall 9 of the track 4, as is known.

Figure 3:
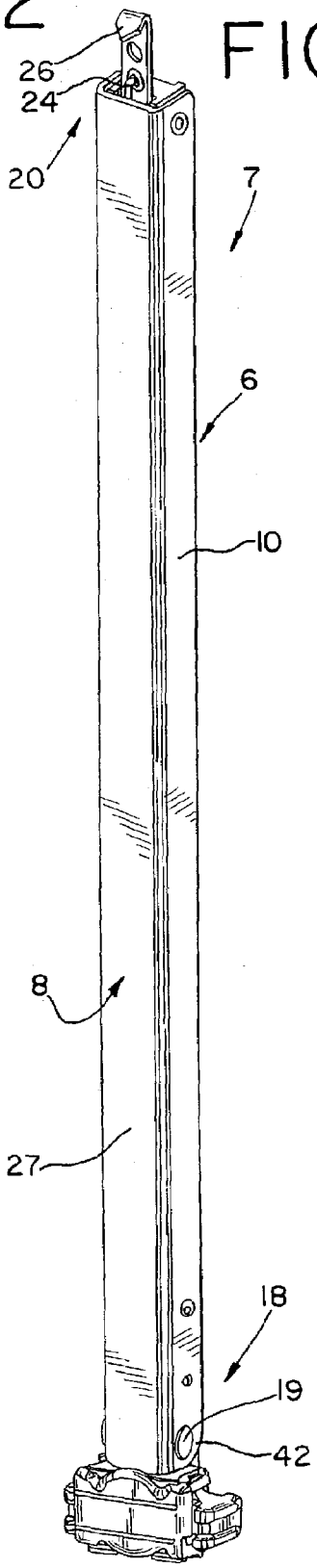
FIG. 3 shows a rear perspective view of the sash balance brake shoe assembly of FIG. 2.
Figure 4:
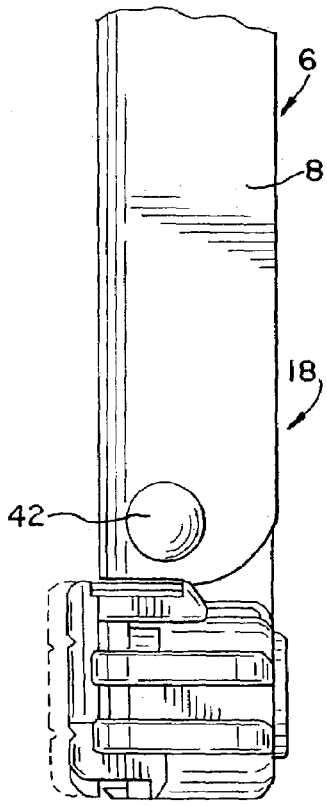
FIG. 4 shows a partial side view of the assembly of FIG. 2.

Integrally formed on the slider body 30 is an extension member 36 having two side surfaces 38 and a rear surface 40. The extension member 36 is formed to be received by and fit within the first end 18 of the balance channel 6. The extension member 36 further has a pair of apertures 37, one each passing through a respective side surface 38. As shown in FIGS. 2–4, the extension member 36 is positioned within the balance channel 6 wherein the apertures 37 and openings 11 are in registration. A fastener 42 passes through the balance channel openings 11 and through the apertures 37 of the extension member 36 to directly attach the brake shoe 28 to the balance channel 6. In this way, the rear surface 40 generally abuts the base 8 and the peripheral edges 29 of the balance channel 6, at the first end 18 are in close proximity to the front face 39 of the slider body 30. It can also be seen from FIGS. 1 & 2 that in this first described embodiment, the side walls 10 extend away from the base 8 towards the vertical stile 25 of sash window 3.

As can be seen in FIGS. 1–7, the brake shoe 28 is adapted to be operably connected to the window sash 3 and slides within the track or shoe channel 4 in response to similar sliding motion of the sash 3 within the frame 5. As the sash 3 is raised or lowered within the frame 5, it can be seen that the block and tackle balance assembly 7 provides a counter balance force to the sash 3 to assist in raising, lowering and positioning the sash 3 within the frame 5.

It is understood that the fastener 42 may be replaced with any suitable connective means readily known in the prior art including, but not limited to a nut and bolt arrangement, cotter pin arrangement, snap fit or interference fit pin arrangement, or any other removable and/or reusable connective means. Additionally, fasteners or connective means can be conceived that do not pass entirely through both channel side walls 10 that would properly be within the scope of the present invention. For instance, the fastener could consist of a type of gluing or other bonding between the balance channel 6 and brake shoe 28.

An additional preferred embodiment is shown in FIGS. 8–14. Elements of the additional preferred embodiment that are substantially similar to corresponding elements of the first described preferred embodiment are referred to using similar reference numbers.

FIGS. 8–11 depict a brake shoe 228 of the second-described preferred embodiment. An extension member 236 integrally formed on a portion of a slider body 230, is formed to fit within a balance channel 206. The extension member 236 has a pair of side surfaces 238 and a rear surface 240. A shoe ear 239 is integrally formed on each side surface 238. The shoe ears 239 are oblong in shape and extend away from the side surfaces 238 at an oblique angle. Integrally formed in the rear surface 240 is a rear snap 241. The rear snap 241 is generally triangular in cross section. It is understood that the ears 239 and snap 241 can take a variety of different forms and cross sections.

As further shown in FIGS. 12–16, the balance channel 206 generally includes a pair of side walls 210 and a base 208. The base 208 has an outer surface 227. An oblong slot 243 is formed in each balance channel side wall 210 near a first end 218 of the balance channel 206. Formed in the base 208 of the balance channel 206 is a generally rectangular snap opening 245.

Figure 13:
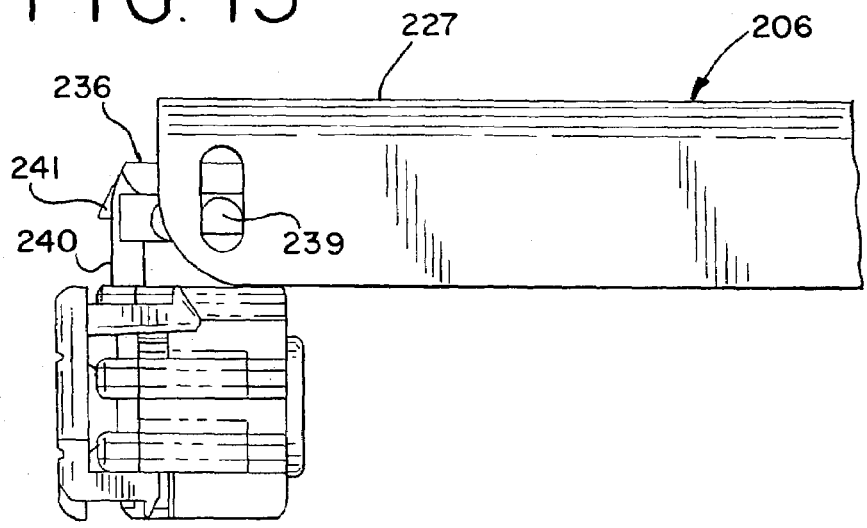
FIG. 13 shows a partial side view of a partially assembled second embodiment of the sash balance brake shoe assembly of the present invention.
Figure 14:
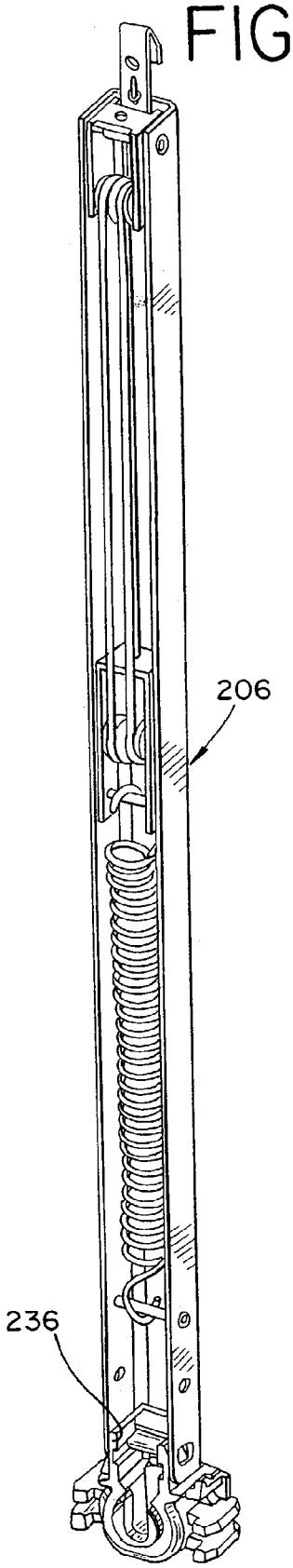
FIG. 14 shows a front perspective view of a second embodiment of a sash balance brake shoe assembly embodying the present invention.
Figure 15:
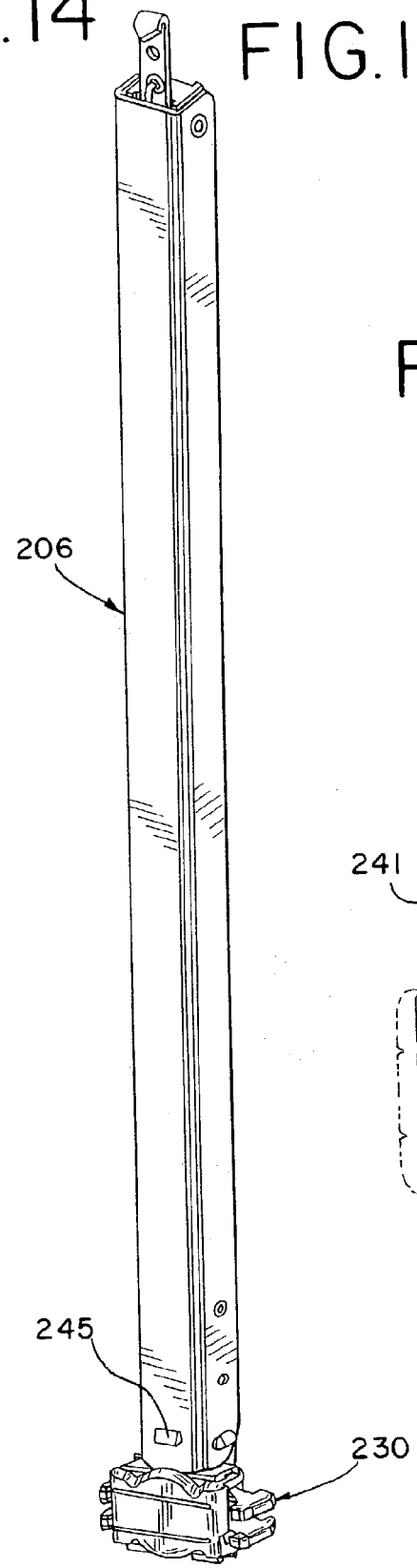
FIG. 15 shows a rear perspective view of the assembly of FIG. 14.
Figure 16:
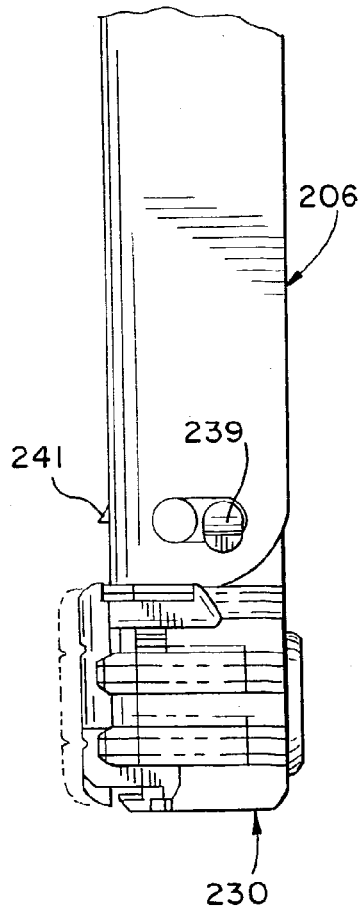
FIG. 16 shows a partial side view of the assembly of FIG. 14.

The balance channel 206 is adapted to receive the brake shoe 228 and both are adapted to fix the brake shoe 228 directly to balance channel 206. The balance channel 206 is passed over the extension member 236 of the brake shoe 228 at a ninety degree angle as shown in FIG. 13. The extension member 236 is then inserted into the first end 218 of the balance channel 206. This results in the channel side walls 210 spreading apart and then snapping back to their original position as the shoe ears 239 each enter a respective oblong slot 243. At this point, the brake shoe 228 and the balance channel 206 are in the relative position to one another as shown in FIG. 13. From this position, the brake shoe 228 is rotated in a clockwise direction, as shown in FIG. 13, to a position in line with the balance channel 206. This in-line position is depicted in FIGS. 14–15. Upon reaching this in-line position, the rear snap 241 passes through the snap opening 245. It can be seen that the oblong slots 243 and the snap opening 245 cooperate respectively and in conjunction with the shoe ears 239 and the rear snap 241 to directly fix the brake shoe 228 to the balance channel 206.

An additional preferred embodiment is shown in FIGS. 18–21. Elements of this additional preferred embodiment that are substantially similar to corresponding elements of the first and second described embodiment are referred to using the same or similar reference numbers.

The sash balance brake shoe assembly 302 of the third-described preferred embodiment generally includes a block and tackle balance assembly 307 and a brake shoe 328.

The block and tackle assembly 307 includes, in part, a balance channel 306. The balance channel 306 is comprised of a base 308 and a pair of side walls 310. The base 308 has an outer surface 327. Each side wall has a peripheral edge 329 located distal from the base 308.

The balance channel 306 further has a first end 318. Located near the first end 318 is a first pair of openings 311, one each located in a respective side wall 310. Also located near the first end 318 is a second pair of openings 315, one each located in a respective side wall 310. The first pair of openings 311 and the second pair of openings 315 are each located equidistant from the first end 318 of the balance channel 306. The first pair of side openings 311 is located between the base 308 and the second pair of side openings 315.

The brake shoe 328 of the third-described preferred embodiment has an extension member 336 integrally formed on a portion of the slider body 330. The slider body 330 has a front face 339. The extension member 336 has a pair of side surfaces 338 and a rear surface 340. The side surfaces 338 and rear surface 340 are adapted to fit within the second end 316 of the balance channel 306. The extension member 336 further has a pair of apertures 337, one each passing through a respective side surface 338. A brake pad 334 is adapted to be received by the brake shoe 328.

Figure 19:
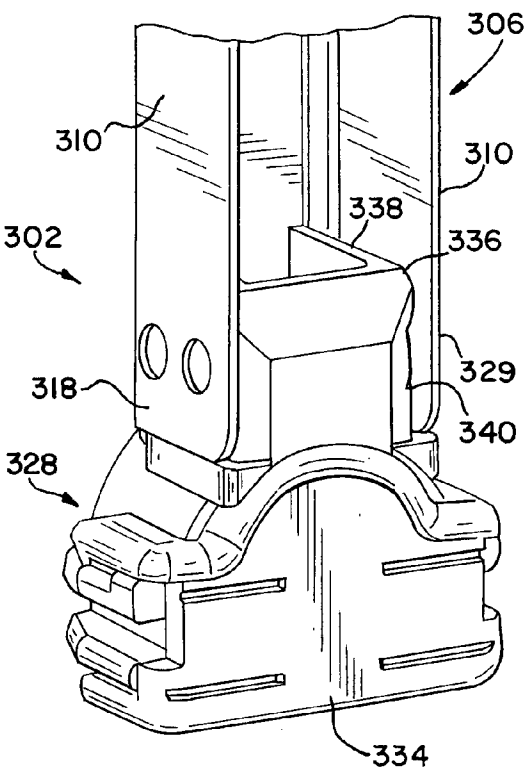
FIG. 19 is a partial rear perspective view of the third embodiment of the sash balance and brake shoe assembly of the present invention.
Figure 18:
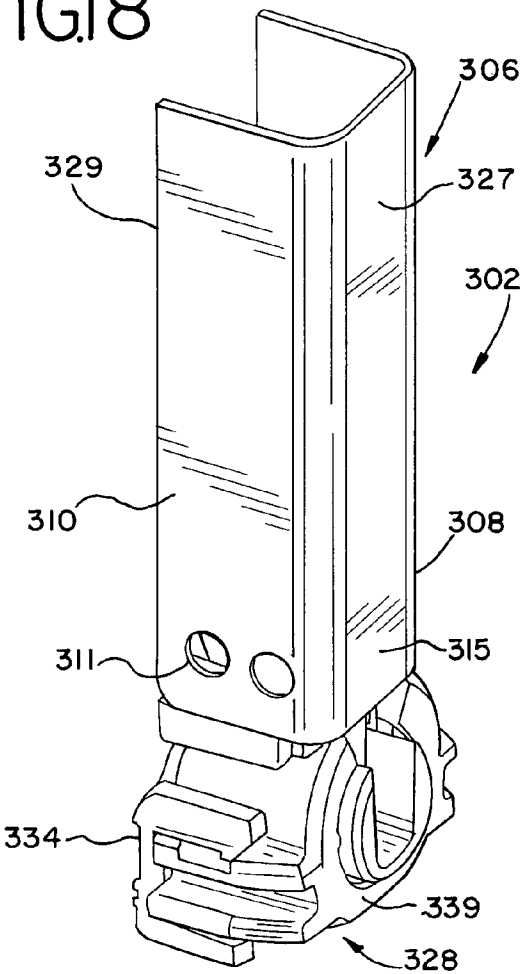
FIG. 18 is a partial front perspective view of a third embodiment of the sash balance and brake shoe assembly of the present invention.

The extension member 336 is positioned within second end 316 wherein the apertures 337 and second pair of openings 315 are in registration. A fastener (not shown) similar to fastener 42 of the first described embodiment passes through the second pair of openings 315 of the balance channel 306 and through the apertures 337 of extension member 336. In this way, the brake shoe 328 is directly attached to the balance channel 306. As shown in FIG. 19, in the connection of the third-described embodiment, the rear surface 340 of the extension member 336 is positioned opposite the base 308 and is in close proximity to the peripheral edges 329 of the side walls 310. Also, the outer surface 327 of the balance channel 308 is proximate to and faces the same direction as the front face 339 of the brake shoe 328.

FIG. 21 shows a schematic cross section view of the balance channel 306 located within the track or shoe channel 4. As can be seen, the outer surface 327 of channel base 308 is adjacent to an inner surface of track shoulders 17 and peripheral edges 329 are adjacent to track base 308. The channel base 308 also is positioned adjacent the slot 19. This closes the slot 19 and hides the inner structure of the balance assembly thus providing a more aesthetically pleasing configuration. The brake pad 334 is positioned below the peripheral edges 329 of the balance channel 306.

This embodiment also allows the extension member 336 to be positioned within first end 318 such that apertures 337 of extension member 336 are in registration with the first pair of openings 311. In this configuration (not shown), the rear surface 340 of the extension member 336 is within the balance channel 306 and adjacent to the base 308, similar to the configuration of the first described embodiment.

The discussion above regarding the potential alternatives to fastener 42 of the first described embodiment is equally applicable to the fastener of the third described embodiment.

Figure 17:
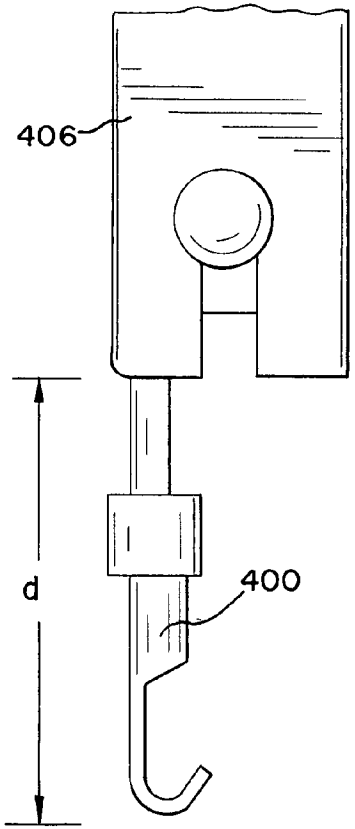
FIG. 17 PRIOR ART
FIG. 17 is a partial side view of a prior art block and tackle assembly connector for a brake shoe.
Figure 20:
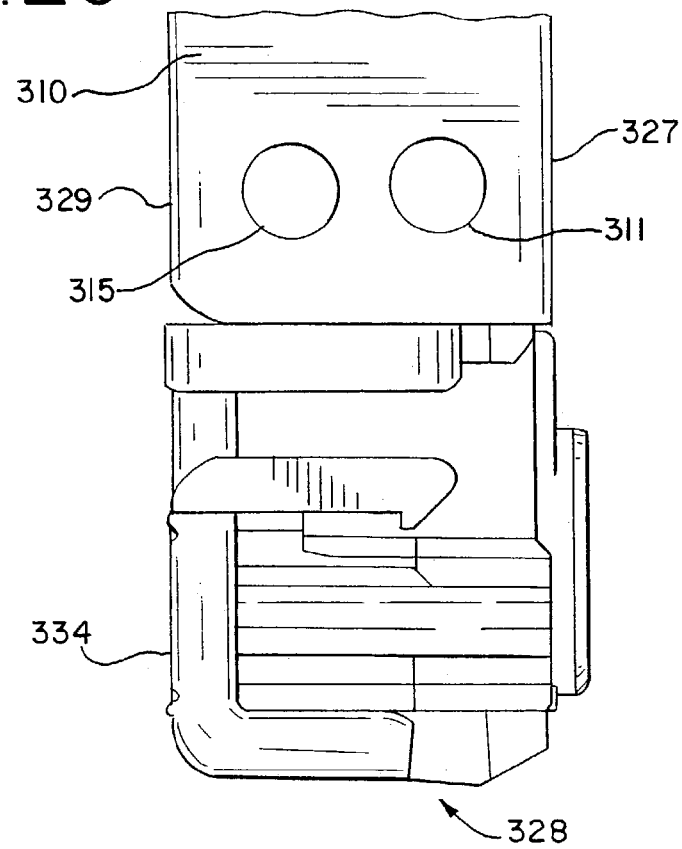
FIG. 20 is a partial side elevation view of the third embodiment of the sash balance and brake shoe assembly of the present invention.

As can be seen from the above description, the brake shoe of the present invention is directly attached to the balance channel of the block and tackle balance assembly. The advantages of this direct attachment can be seen by reference to FIG. 17, which depicts a typical means of attaching a balance channel 406 to a brake shoe or other structure. This typical means of attachment of the prior art consists of an intermediate structure such as a hook 400. Use of the hook 400 reduces the range of slidable motion available to the window sash by a distance d. The present invention eliminates the need for intermediate structure to attach the balance channel and brake shoe as these components are directly attached. By virtue of this direct attachment, the distance d is eliminated thereby increasing the range of slidable motion available to a window sash 3. This increase is critical in that it provides for an increased egress opening available to an occupant of an enclosure during an emergency.

While the specific embodiments and various details thereof have been illustrated and described, numerous modification come to mind without significantly departing from the spirit of the invention and the scope of protection is only limited by the following claims.

What is claimed is:

1. A sash balance shoe assembly for providing a counterbalancing force to a sash window slideable within a frame, the assembly comprising:

a block and tackle balance assembly having a balance channel, one end of the balance assembly adapted to be connected to the frame;

a shoe adapted to be connected to the sash window, the shoe being directly connected to the balance channel; and, wherein the shoe has an extension member and the balance channel having a base and a pair of substantially parallel walls extending from the base, the extension member positioned within the walls.

2. A sash balance shoe assembly for providing a counterbalancing force to a sash window slideable within a frame, the assembly comprising:

a block and tackle balance assembly having a balance channel, one end of the balance assembly adapted to be connected to the frame;

a shoe adapted to be connected to the sash window, the shoe being directly connected to the balance channel; and wherein the shoe has opposed sidewalls, each sidewall having a guide member extending therefrom, the guide member comprising a pair of spaced, substantially horizontal rails.

3. A sash balance brake shoe assembly for providing a counterbalancing force to a sash window slideable within a frame, the assembly comprising:

a block and tackle balance assembly having a balance channel, one end of the balance assembly adapted to be connected to the frame;

a brake shoe adapted to be connected to the sash window, the brake shoe being directly connected to and in engagement with the balance channel by a fastener positioned between the brake shoe and the balance channel; and, wherein the balance channel has a base and a pair of substantially parallel walls extending from the base, the brake shoe having an extension member being received by the balance channel.

4. A sash balance brake shoe assembly for providing a counterbalancing force to a sash window slideable within a frame, the assembly comprising:

a block and tackle balance assembly having a balance channel, one end of the balance assembly adapted to be connected to the frame;

a brake shoe adapted to be connected to the sash window, the brake shoe being directly connected to and in engagement with the balance channel by a fastener positioned between the brake shoe and the balance channel; and wherein the balance channel has a base and a pair of substantially parallel walls extending from the base, the brake shoe having an extension member that receives the balance channel.

5. A sash balance brake shoe assembly for providing a counterbalancing force to a sash window slideable within a frame, the assembly comprising:

a block and tackle balance assembly having a balance channel, one end of the balance assembly adapted to be connected to the frame;

a brake shoe adapted to be connected to the sash window, the brake shoe being directly connected to and in engagement with the balance channel by a fastener positioned between the brake shoe and the balance channel; and wherein the fastener is a rivet.

6. A sash balance assembly for providing a counterbalancing force to a sash window slideable within a frame, the sash window having a generally vertical stile, the frame having a shoe channel having a rear wall and a front wall having a pair of shoulders separated by a slot, the assembly comprising:

a block and tackle balance assembly having a balance channel, one end of the balance assembly adapted to be connected to the frame, the balance channel further having a base with an outer surface;

a shoe adapted to be connected to the sash window, the shoe being directly connected to the balance channel;

wherein the outer surface is adapted to face toward the vertical stile;

a pair of side walls extending from the base opposite to the outer surface, the side walls each having a peripheral edge; and, a brake pad operably connected to the shoe;

wherein the brake pad is adjacent to the peripheral edges.

7. A sash balance assembly for providing a counterbalancing force to a sash window slideable within a frame, the sash window having a generally vertical stile, the frame having a shoe channel having a rear wall and a front wall having a pair of shoulders separated by a slot, the assembly comprising:

a block and tackle balance assembly having a balance channel, one end of the balance assembly adapted to be connected to the frame, the balance channel further having a base with an outer surface;

a shoe adapted to be connected to the sash window, the shoe being directly connected to the balance channel;

wherein the outer surface is adapted to face toward the vertical stile; and, a pair of side walls extending from the base opposite to the outer surface, the side walls each having a peripheral edge;

wherein the peripheral edges are adapted to be positioned adjacent to the rear wall.

* * * * *